US005800251A

United States Patent [19]

Nakazato et al.

[11] Patent Number: 5,800,251

[45] Date of Patent: Sep. 1, 1998

[54] APPARATUS AND METHOD OF LAPPING WORKS

[75] Inventors: Yasuaki Nakazato, Koushoku; Kazuo Kubota; Hisakazu Takano, both of Nagano, all of Japan

[73] Assignee: Shin-Etsu Handotai Co., Ltd., Tokyo, Japan

[21] Appl. No.: 822,461

[22] Filed: Mar. 21, 1997

[30] Foreign Application Priority Data

Mar. 27, 1996 [JP] Japan ..... 8-072650

[51] Int. Cl.[6] ..... B24B 5/00

[52] U.S. Cl. ..... 451/41; 451/57; 451/60; 451/285; 451/286; 451/287; 451/288; 451/289; 451/446

[58] Field of Search ..... 451/41, 57, 60, 451/285–289, 446

[56] References Cited

U.S. PATENT DOCUMENTS

| | | | |
|---|---|---|---|
| 2,780,038 | 2/1957 | Laverdisse | 451/60 |
| 5,490,809 | 2/1996 | Jones et al. | 451/60 |
| 5,575,705 | 11/1996 | Yam et al. | 451/39 |
| 5,664,990 | 9/1997 | Adams et al. | 451/446 |
| 5,676,587 | 10/1997 | Landers et al. | 451/57 |

OTHER PUBLICATIONS

Patent Abstracts of Japan, vol. 17, No. 139 (M–1385), Mar. 22, 1993 & JP 04 315576A (Japan Small Corp.), Nov. 6, 1992.

Patent Abstracts of Japan , vol. 10, No. 365 (M–542), Dec. 6, 1986 & JP 61 159368 A (Naoetsu Denshi Kogyo KK, Others: 01), Jul. 19, 1986.

Patent Abstracts of Japan, vol. 15, No. 003 (E–1019), Jan. 7, 1991 & JP 02 257627 A (Kyushu Electron Metal Co., Ltd., Others: 01), Oct. 18, 1990.

Patent Abstracts of Japan, vol. 95, No. 10, Nov. 30, 1995 & JP 07 186041 A (Murata Kogyo KK), Jul. 25, 1995.

*Primary Examiner*—Robert A. Rose
*Assistant Examiner*—George Nguyen
*Attorney, Agent, or Firm*—Nikaido, Marmelstein, Murray & Oram LLP

[57] ABSTRACT

A lapping apparatus and a method for effectively utilizing a regenerated abrasive fluid in the lapping process of works such as semiconductor wafers or quartz wafers without causing any damage such as scratches to the works.

A work lapping method using a regenerated abrasive fluid prepared from a used abrasive fluid and a new abrasive fluid, which comprises the steps of preliminarily lapping a work using the regenerated abrasive fluid to a predetermined stock removal of the work, and finally lapping the preliminarily lapped work using the new abrasive fluid.

7 Claims, 4 Drawing Sheets

APPARATUS AND METHOD OF LAPPING WORKS

BACKGROUND OF THE INVENTION

1. Field of the Invention

The present invention relates to an apparatus and a method of lapping works, such as semiconductor wafers, for instance, silicon wafers and gallium-arsenide wafers, and quartz wafers.

2. Description of the Related Art

For the lapping process of works, such as semiconductor wafers, an abrasive fluid containing abrasive grains is used. The abrasive grains contained in the abrasive fluid are needed to have high purity and excellent grain size distribution. Meanwhile, recycling of the used abrasive fluid is attempted to decrease the cost of lapping by improving the working efficiency of the abrasive fluid and suppress the environmental pollution due to the abandonment of the used abrasive fluid. However, such recycling of the used abrasive fluid leads to the reduction of the working efficiency because the grain size of the abrasive grains in the abrasive fluid is decreased by wearing out of the abrasive grains by friction against the lapping turn table and the work during the lapping process.

Further, since fine metallic powder generated by wearing out of the lapping turn table and of lapping means (generally referred to as "lapping carrier") for holding the works is included in the used abrasive fluid, the lapped work tends to be scratched by the metallic fine powder in using repeatedly the used abrasive fluid. Therefore, taking the above problem into consideration, the abrasive fluid once used in the lapping process is conventionally collected and abandoned.

A method for reusing of a used abrasive fluid wherein an abrasive fluid once used in a lapping process is regenerated and reused in a circulation state was proposed (Japanese Patent Laid-Open Publication No. 4-315576). According to the proposed method, regeneration of the used abrasive fluid is carried out by separating fine abrasive grains and the like from the used abrasive fluid by the use of a filter and eliminating iron filings with the aid of an iron eliminating apparatus. Thereafter, a new abrasive fluid is added to the regenerated abrasive fluid to produce a prepared abrasive fluid which is used in a lapping process.

However, there are mixed in a suspended state in the used abrasive fluid fine powder of work processed layers generated when lapping the work and fine metallic powder generated by wearing out of the lapping means during lapping. It is impossible for the abovementioned filter and iron eliminating apparatus to perfectly separate and eliminate such suspended work processed layers and fine metallic powder without change of the grain size distribution of the abrasive grains.

Thus, fine metallic powder and the like are still contained in the prepared abrasive fluid of the above conventional method. Therefore, there are generated as before scratches in the work lapping by the conventional method due to the presence of such fine metallic powder in the prepared abrasive fluid.

SUMMARY OF THE INVENTION

With the foregoing problems in view, it is an object of the present invention to provide a work lapping method and a work lapping apparatus for effectively utilizing a regenerated abrasive fluid in the lapping process of works such as semiconductor wafers or quartz wafers without causing any damage such as scratches to the works.

In one aspect, the present invention provides a work lapping method using a regenerated abrasive fluid prepared from a used abrasive fluid and a new abrasive fluid, which comprises the steps of preliminarily lapping a work using the regenerated abrasive fluid to a predetermined stock removal of the work, and finally lapping the preliminarily lapped work using the new abrasive fluid.

The regenerated abrasive fluid is preferably prepared by removing fine abrasive grains having a grain size not larger than predetermined grain size from the used abrasive fluid which was used once or more times in the lapping process.

Specifically, fine abrasive grains having grain size not more than 50% of the grain size of the abrasive grains in the new abrasive fluid are removed from the used abrasive grains contained in the regenerated abrasive fluid so as to make the average grain size of the used abrasive grains substantially equal to that of the abrasive grains in the new abrasive fluid with a result that the efficiency of the lapping process using such regenerated abrasive fluid is by no means inferior to the case of using the new abrasive fluid only .

It is preferred that the stock removal of the work during the preliminary lapping process using the regenerated abrasive fluid is in the range of 95% to 50% of the total stock removal of the work during the whole lapping process using both the regenerated and new abrasive fluid.

If the stock removal of the work during the final lapping process using the new abrasive fluid is smaller than 5%, that is, if the stock removal of the work during the preliminary lapping process using the regenerated lapping slurry is larger than 95%, the damages as of scratches may occur in the work. Further, it is undesirable from an economical view point that the stock removal of the work during the final lapping process using the new abrasive fluid exceeds 50% or that the stock removal of the work during the preliminary lapping process using the regenerated abrasive fluid is less than 50%.

With the above arrangement wherein after the completion of the preliminary lapping process using the regenerated abrasive fluid, the final lapping process using the new abrasive fluid is carried out, the scratches once generated in the work by dint of the regenerated abrasive fluid during the preliminary lapping process can be eliminated by the effect of the new abrasive fluid during the succeeding final lapping process. Therefore, the work lapping method according to the present invention is capable of lapping the work without scratches. The stock removal of the work during the final lapping process using the new abrasive fluid depends on the size of the fine metallic powder mixed in the regenerated abrasive fluid. If the stock removal of the work during the final lapping process is 5 to 50% of the total stock removal of the work, substantially the same effect can be obtained. Moreover, in order to improve an economic effect by the reduction of the material cost of the new abrasive fluid being larger than the cost required for regeneration of the used abrasive fluid, it is preferred to set the stock removal of the work during the final lapping process within the range of 5 to 20% of the total stock removal of the work.

The stock removal of the work is detected on the basis of the difference between the work thickness at the start of the preliminary lapping process using the regenerated abrasive fluid and the work thickness after the preliminary lapping process is conducted for a predetermined time. When the stock removal of the work during the preliminary lapping process using the regenerated abrasive fluid reaches a predetermined amount, the new abrasive fluid is supplied by changing the regenerated abrasive fluid to the new one so that the desired change of the regenerated abrasive fluid to the new one can be effected without any exclusive sensors for changing an abrasive fluid.

In another aspect, the present invention provides a work lapping apparatus for carrying out the above-mentioned work lapping method, which comprises a lapping machine, means for supplying a regenerated abrasive fluid to the lapping machine, means for supplying a new abrasive fluid to the lapping machine, and means for changing the supply between the regenerated abrasive fluid and the new abrasive fluid.

Preferably, the work lapping apparatus further includes work thickness measuring means mounted on the lapping machine and detection and command means for detecting the fact that the stock removal of the work reaches a predetermined level from a signal supplied by the work thickness measuring means and feeding a command signal of changing the supply of an abrasive fluid to the above mentioned supply changing means so as to change the supply from the regenerated abrasive fluid to the new abrasive fluid, whereby automatic changing of the supply from the regenerated abrasive fluid to the new abrasive fluid can be carried out on the basis of the predetermined stock removal of the work.

The above and other objects, features and advantages of the present invention will become manifest to those skilled in the art on making reference to the detailed description and the accompanying sheets of drawings.

DETAILED DESCRIPTION

The present invention will be described below in greater detail by way of the following embodiments which should be construed as illustrative rather than restrictive.

Figure 1:
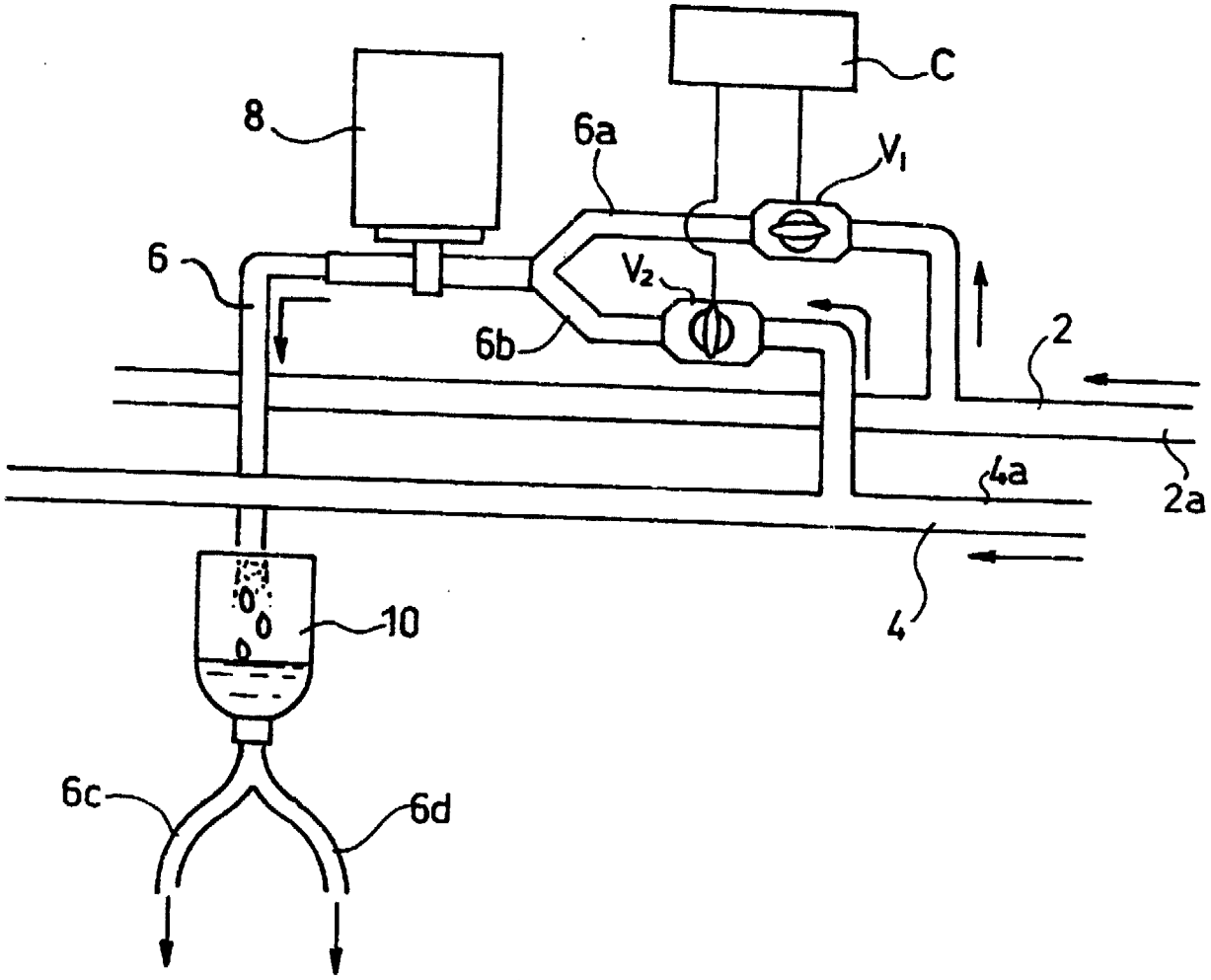
FIG. 1 is a schematic diagram showing a mechanism for changing the supply from a regenerated abrasive fluid to a new abrasive fluid according to the present invention.

In FIG. 1, reference numeral 2 designates a supply line for supplying regenerated abrasive fluid 2*a* which constitute a lapping apparatus of the present invention. The regenerated abrasive fluid 2*a* is regenerated by removing fine abrasive grains having grain size not larger than a predetermined level (for example, not larger than 50% of the grain size of new abrasive grains) with separating operation using, for example, a separator (E) from used abrasive fluid which is discharged from a lapping machine 22 (shown in FIG. 2) and collected in a tank T. A new abrasive fluid 4*a* is supplied by a supply line 4 extending in parallel with the regenerated abrasive fluid supply line 2.

In the above separating operation, a cyclone type separator (E) such as a liquid cyclone is preferably usable. In the liquid cyclone, an abrasive fluid containing in a suspension state abrasive grains smaller than predetermined grain size, for instance, smaller than 2 μm is discharged from an upper outlet and an abrasive fluid containing in a suspension state abrasive grains not smaller than predetermined grain size, for instance, not smaller than 2 μm is discharged form a lower outlet (for example, Japanese Patent Publication No. 7-41535). For this liquid cyclone type separating machine, a SRS system (trade name for a liquid cyclone type separating machine manufactured by HITACHI ZOSEN METAL WORKS CO., LTD.) is preferably usable.

Referring back to FIG. 1, designated by 6 is a main supply line for supplying the abrasive fluid to the lapping machine 22. The main supply line 6 has two branch lines 6*a*, 6*b* at its base end portion. These two branch lines 6*a*, 6*b* are in communication with the regenerated abrasive fluid supply line 2 and the new abrasive fluid supply line 4 via change-over valves $V_1$, $V_2$, respectively.

Designated by 8 and 10 are a constant supply pump and a tank which are disposed in the middle portion of the main supply line 6, respectively. The abrasive fluid discharged from the tank 10 is supplied to the lapping machine 22 through branch lines 6*c*, 6*d* at the distal end of the main supply line 6.

The change-over valves $V_1$, $V_2$ so operate that when the one is open, the other is closed. Further, the change-over valves $V_1$, $V_2$ are electrically connected to a work thickness measuring device (D) of the lapping machine 22 through a computer (C) as shown in FIG. 2.

The measuring device (D) measures the work thickness at the start of the preliminary lapping process using the regenerated abrasive liquid and the work thickness after the preliminary lapping process is conducted for a predetermined time, respectively. The computer (C) calculates the stock removal of the work on the basis of the difference between the two thickness values. When the computer (C) detects the fact that the stock removal of the work reaches a predetermined amount, opening and closing operations of the change-over valves $V_1$, $V_2$, that is, changing from opening to closing of the valve $V_1$ and from closing to opening of the valve $V_2$ are respectively carried out by a command signal from the computer (C).

Figure 2:
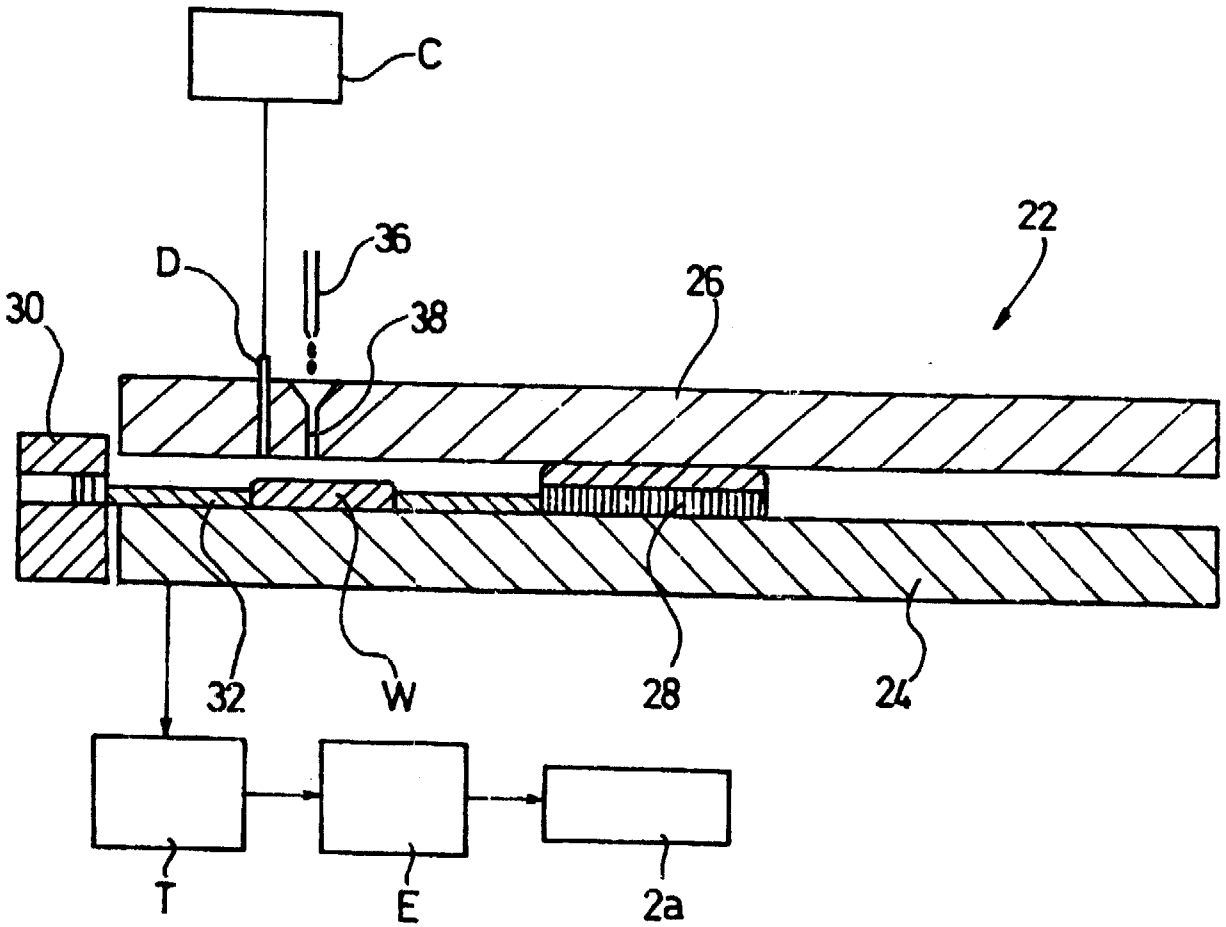
FIG. 2 is a cross sectional schematic view of a lapping machine.

As shown in FIG. 2, the lapping machine 22 includes a lower lapping turn table 24 and an upper lapping turn table 26 facing in parallel with each other. The upper and lower lapping turn table 24, 26 are moved reversely to each other by a driving means (not shown). The lower lapping turn table 24 has a central gear 28 on the upper face of its central portion, and an internal gear 30 is disposed around the central gear 28.

Reference numeral 32 denotes a carrier of disc type which is supported between the upper surface of the lower lapping turn table 24 and the lower surface of the upper lapping turn table 26 and rotates and revolves slidably between the upper surface of the lower lapping turn table 24 and the lower surface of the upper lapping turn table 26 under the action of the central gear 28 and the internal gear 30.

The carrier 32 has a plurality of wafer holes 34. Wafers (W) which are to be lapped are set in the wafer holes 34. When the wafers (W) are lapped, an abrasive fluid is supplied to spaces between the wafers (W), the lower lapping turn table 24 and the upper lapping turn table 26 via a hole 38 formed in the upper lapping turn table 26 from a nozzle 36 connected to the branch lines 6*c*, 6*d* at the distal end of the supply line 6. As the carrier 32 rotates and revolves slidably between the lower lapping turn table 24 and the upper lapping turn table 26, thereby the wafers (W) being lapped.

In FIG. 2, designated by (D) is a thickness measuring device which is disposed in the upper lapping turn table 26. Designated by (C) is a computer which is electrically connected with the thickness measuring device (D) and the above-mentioned change-over valves $V_1$, $V_2$. The computer (C) detects the stock removal of the work on the basis of a thickness measurement signal from the thickness measuring device (D). The computer (C) detects the fact that the stock removal of the work reaches a predetermined level, it sends a change-over command signal to the change-over valves $V_1$, $V_2$, thereby the valves $V_1$, $V_2$ are changed over, respectively.

As the work to be lapped by the lapping machine 22, there can be mentioned semiconductor wafers, such as silicon wafers and gallium-arsenide wafers, and quartz wafers, etc.

The invention will be further described by way of the following examples which should be construed illustrative rather than restrictive.

EXAMPLE 1

Figure 3:
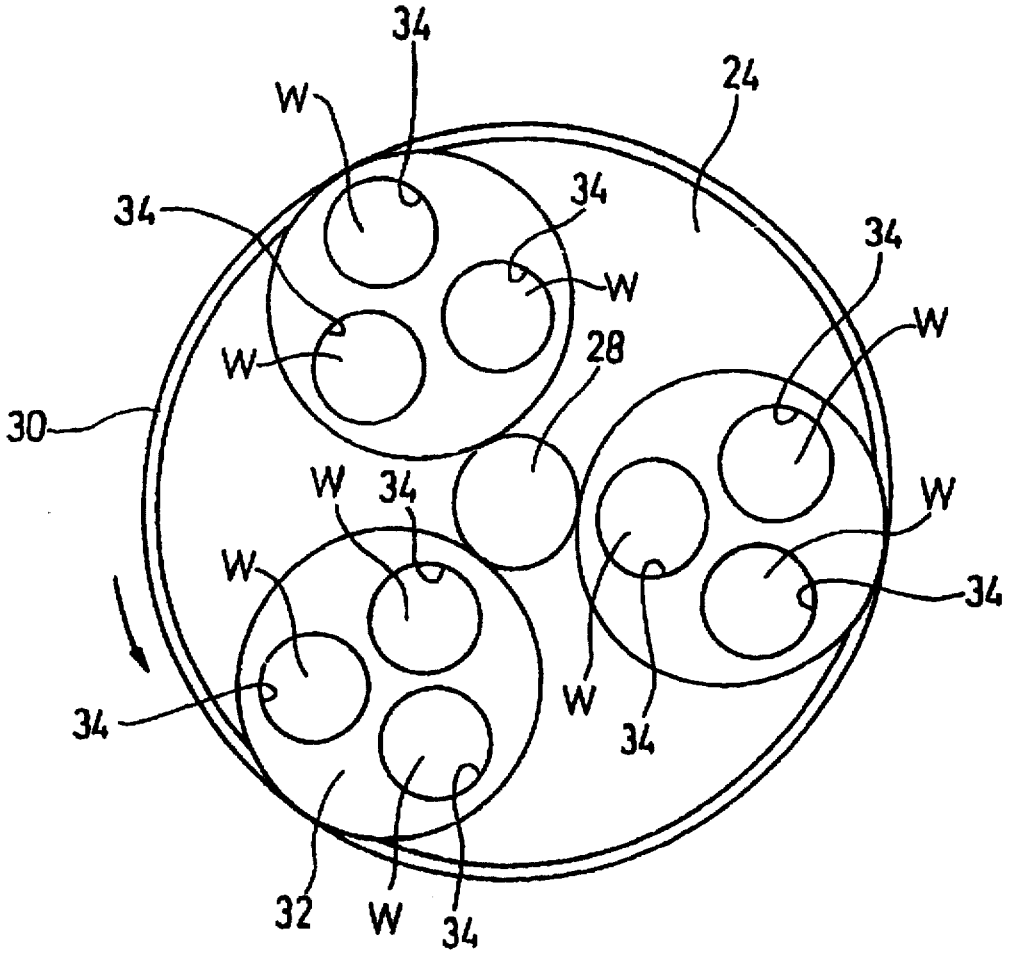
FIG. 3 is a schematic plan view showing a lapping machine in which an upper lapping turn table is removed.

A silicon wafer was lapped using the lapping apparatus shown in FIGS. 1 to 3 and a new abrasive fluid containing $Al_2O_3$ of grain size # 1000 (average grain size of 12 to 14 μm) to remove a layer of 100 μm thickness from the surface of 100 mm diameter silicon wafers. Thereafter, a regenerated abrasive fluid was prepared by selectively eliminating fine abrasive grains not larger than 2 μm from the used abrasive fluid using a liquid cyclone in accordance with a generally known method (Japanese Patent Laid-Open Publication No.4-315576).

Figure 4:
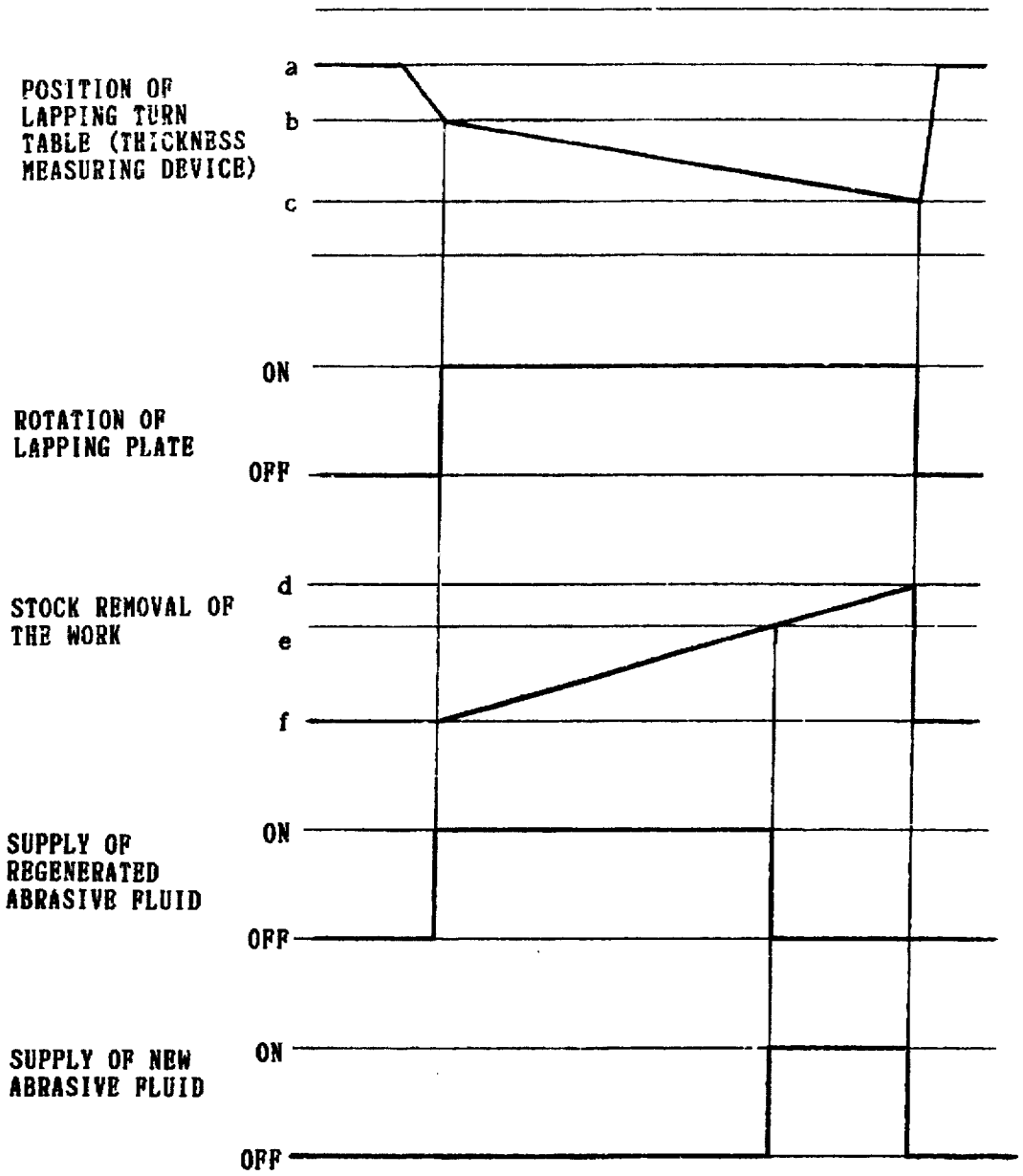
FIG. 4 is a timing chart showing relationships between an ON-OFF state of each member in Example 1, positions of the lapping turn table and the stock removal of the work.

According to a timing chart shown in FIG. 4, a lapping experiment was conducted using 500 sheets of 100 mm diameter silicon sample wafers. First, the preliminary lapping process was carried out using the above regenerated abrasive fluid to remove a layer of 70 μm thickness from the surface of each of the silicon sample wafers. Thereafter, a layer of 30 μm thickness was further removed from each of the preliminarily lapped wafer surfaces by the final lapping process using the new abrasive fluid containing $Al_2O_3$ of grain size # 1000. The results of the experiment are shown in Table 1.

As is apparently seen from Table 1, no scratch was observed in the lapped silicon wafers under a fluorescent light. Thus, extremely excellent lapping was carried out in Example 1.

In FIG. 4, reference character (a) denotes an upper limit position of the lapping turn table (when the thickness measuring device is OFF), (b) a lapping start position of the lapping turn table (when the thickness measuring device is ON), (c) a lapping end position of the lapping turn table (when the thickness measuring device is OFF), (d) a total predetermined stock removal of the work, (e) a stock removal of the work predetermined in the lapping process using the regenerated abrasive fluid, and (f) 0 point of the stock removal of the work (a resetting position).

COMPARATIVE EXAMPLE 1

An abrasive fluid was prepared in the same manner as disclosed in Japanese Patent Laid-Open Publication No. 4-315576 using the same sample wafers as described in Example 1. The regenerated abrasive fluid was then mixed with a new abrasive fluid to prepare a mixed abrasive fluid. Thereafter, a 100 μm thickness layer was removed from the surface of each of the sample wafers using the mixed abrasive fluid. The results of this experiment are shown in Table 1 together with the results of Example 1.

As seen from Table 1, scratches were observed in 78 of 500 sheets (16%) of the lapped sample wafers under a fluorescent light. Thus, poor lapping was carried out in Comparative Example 1.

TABLE 1

| | Example 1 | Comparative Example 1 |
|---|---|---|
| Occurrence of scratches | 0% (0 sheet/500 sheets) | 16% (78 sheets/500 sheets) |
| Processing efficiency | 2.3 μm/min | 2.2 μm/min |

As stated above, according to the present invention, the used abrasive fluid can be regenerated so that the work lapping process can be carried out without occurrence of any scratches and hence the utilization efficiency of the abrasive fluid can be improved, and the lapping cost can be decreased significantly. In addition, the environmental pollution by abandonment of the abrasive fluid can be suppressed.

Obviously, various minor changes and modifications of the present invention are possible in the light of the above teaching. It is therefore to be understood that within the scope of the appended claims the invention may be practiced otherwise than as specifically described.

What is claimed is:

1. A work lapping method using a regenerated abrasive fluid prepared from a used abrasive fluid and a new abrasive fluid, which comprises the steps of preliminarily lapping a work using the regenerated abrasive fluid to a predetermined stock removal of the work, and finally lapping the preliminarily lapped work using the new abrasive fluid.

2. A work lapping method according to claim 1, wherein the regenerated abrasive fluid is prepared by removing fine abrasive grains having grain size not larger than predetermined grain size from the used abrasive fluid which was used once or more times in the lapping process.

3. A work lapping method according to claim 2, wherein the predetermined grain size is 50% of the size of abrasive grains contained in the new abrasive fluid.

4. A work lapping method according to claim 1, wherein the stock removal of the work during the preliminary lapping process using the regenerated abrasive fluid is in the range of 95% to 50% of the total stock removal of the work during the whole lapping process using both the regenerated and new abrasive fluids.

5. A work lapping method according to claim 1, wherein the work is a semiconductor wafer or a quartz wafer.

6. A work lapping apparatus for carrying out the work lapping method according to claim 1, which comprises a lapping machine, means for supplying a regenerated abrasive fluid to the lapping machine, means for supplying a new abrasive fluid to the lapping machine, and means for changing the supply between the regenerated abrasive fluid and the new abrasive fluid.

7. A work lapping apparatus according to claim 6, which further comprises work thickness measuring means mounted on the lapping machine and detection and command means for detecting the fact that the stock removal of the work reaches a predetermined level from a signal supplied by the work thickness measuring means and feeding a command signal of changing the supply of an abrasive fluid to the above mentioned supply changing means so as to change the supply from the regenerated abrasive fluid to the new abrasive fluid, whereby automatic changing of the supply from the regenerated abrasive fluid to the new abrasive fluid can be carried out on the basis of the predetermined stock removal of the work.

* * * * *